US007500438B2

(12) United States Patent
Tajima et al.

(10) Patent No.: US 7,500,438 B2
(45) Date of Patent: Mar. 10, 2009

(54) CHAIN-STITCH SEWING MACHINE

(75) Inventors: Ikuo Tajima, Nagoya (JP); Satoru Suzuki, Komaki (JP); Yuichiro Suzuki, Kasugai (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 11/720,380

(22) PCT Filed: Nov. 29, 2005

(86) PCT No.: PCT/JP2005/021907

§ 371 (c)(1),
(2), (4) Date: May 29, 2007

(87) PCT Pub. No.: WO2006/057411

PCT Pub. Date: Jun. 1, 2006

(65) Prior Publication Data

US 2008/0029005 A1 Feb. 7, 2008

(30) Foreign Application Priority Data

Nov. 29, 2004 (JP) ..... 2004-344107

(51) Int. Cl.
*D05B 57/02* (2006.01)
*D05B 57/00* (2006.01)

(52) U.S. Cl. ..... 112/197; 112/166; 112/201

(58) Field of Classification Search ..... 112/220, 112/165, 166, 186, 197, 199
See application file for complete search history.

(56) References Cited

U.S. PATENT DOCUMENTS 862,033 A * 7/1907 Toof ..... 112/168
3,747,547 A * 7/1973 Mayer et al. ..... 112/186

(Continued)

FOREIGN PATENT DOCUMENTS

JP 59-211670 A 11/1984
JP 3579801 B2 7/2004

OTHER PUBLICATIONS

Relevant Portion of International Search Report issued in International Application No. PCT/JP2005/021907 (from which this application claims priority), with mailing date of Jan. 31, 2006.

(Continued)

*Primary Examiner*—Ismael Izaguirre
(74) *Attorney, Agent, or Firm*—Rossi, Kimms & McDowell LLP

(57) ABSTRACT

Looper section provided under a needle plate includes: a plurality of loopers arranged in an array along a curved movement path; and a movement mechanism for moving the plurality of loopers along the curved movement path to selectively position one of the plurality of loopers in a predetermined needle drop position. Chain-stitch sewing is performed by cooperation between the one looper selectively positioned in the needle drop position and a hooked needle. The looper section projects at its one end portion including the predetermined needle drop position, and a cylindrical sewing workpiece can be taken to and from the needle drop position via the one projecting end portion. The curved movement path is, for example, a U-shaped path.

9 Claims, 7 Drawing Sheets

U.S. PATENT DOCUMENTS

| | | | | |
|---|---|---|---|---|
| 3,981,256 | A | 9/1976 | Sexton | |
| 5,628,263 | A | 5/1997 | Tajima et al. | |
| 5,664,511 | A * | 9/1997 | Tajima et al. | 112/292 |
| 5,775,243 | A * | 7/1998 | Kinoshita et al. | 112/186 |

OTHER PUBLICATIONS

International Preliminary Report on Patentability and Written Opinion of the International Searching Authority issued in corresponding application No. PCT/JP2005/021907, mailing date Jun. 6, 2007.

* cited by examiner

CHAIN-STITCH SEWING MACHINE

This application is a U.S. National Phase Application of PCT International Application PCT/JP2005/021907 filed on November 29.

1. Technical Field

The present invention relates generally to a chain-stitch sewing machine having a plurality of loopers per sewing head, and particularly to an improvement in a mechanism that selects a desired one of the loopers to effect a thread color change. More particularly, the present invention relates to a looper selection structure suited to perform chain-stitch sewing on a cylindrical sewing workpiece.

2. Background Art

In the conventionally-known chain-stitch sewing machines, chain-stitch sewing is performed on a sewing workpiece through cooperation between a reciprocatively-driven hooked needle and a looper positioned under a needle plate to supply a sewing thread and by rotation of the looper being controlled in synchronism with operation of the hooked needle. Also known today are chain-stitch sewing machines of a type which has a plurality of loopers per sewing head and in which each of the loopers supplies a different sewing thread. Techniques for selecting, from among a plurality of loopers, a particular looper, corresponding to a desired sewing thread, to be positioned in a needle entry position or needle drop position in the aforementioned chain-stitch sewing machines are disclosed, for example, in Japanese Patent Application Laid-open Publication Nos. SHO-59-211670 and HEI-8-155161. According to the techniques disclosed in the SHO-59-211670 and HEI-8-155161, the chain-stitch sewing machines include a horizontally-slidable support, and a plurality of loopers provided on the support at predetermined pitches along the sliding direction of the support; in these chain-stitch sewing machines, a sewing thread color change is made by the support being slid to select a desired one of the loopers.

Because the aforementioned conventional techniques are arranged to move the plurality of loopers linearly in the horizontal direction, they can be applied only to planar sewing workpieces, although sewing workpieces to be processed by the sewing machines also include cylindrical sewing workpieces, such as T-shirts and hats. As well known, in order to perform ordinary sewing or embroidering on a cylindrical sewing workpiece, it is necessary to position a cylindrical rotary hook bead, having a rotary bed provided therein, inside the cylindrical sewing workpiece. Similarly, in order to perform chain-stitch sewing on a cylindrical sewing workpiece, it is necessary to position a looper inside the cylindrical sewing workpiece. However, in the conventional chain-stitch sewing machines constructed to effect a sewing thread color change by selecting a desired one of the plurality of loopers, the looper support has a horizontal width corresponding to the number of the loopers because the plurality of loopers are arranged in a linear horizontal row. In order to perform chain-stitch sewing on a cylindrical sewing workpiece with such conventional chain-stitch sewing machines, there is a need to position the entire looper support, having a horizontal width corresponding to the total number of the loopers, inside the cylindrical sewing workpiece, as well as a need to provide a leeway space to permit sliding movement of the looper support. Therefore, cylindrical sewing workpieces on which the conventional chain-stitch sewing machines can perform chain-stitch sewing are limited to those of relatively great sizes, but also, even for cylindrical sewing workpieces of great sizes on which the conventional chain-stitch sewing machines can perform chain-stitch sewing, sewable ranges of the workpieces are extremely limited. Consequently, the conventional chain-stitch sewing machines would lack practical utility. Thus, in effect, there has heretofore been no chain-stitch sewing machine equipped with a looper selection mechanism suitable for chain-stitch sewing of cylindrical sewing workpieces.

DISCLOSURE OF THE INVENTION

In view of the foregoing, it is an object of the present invention to provide a sewing machine, of a type having a plurality of loopers per sewing head, which has an improved mechanism for selecting a desired one of the loopers. It is another object of the present invention to provide a sewing machine which has a looper selection structure suited for chain-stitch sewing of a cylindrical sewing workpiece using threads of multiple colors.

According to one aspect of the present invention, there is provided a sewing machine including a reciprocatively-driven hooked needle and a looper section disposed under a needle plate, characterized in that the looper section includes: a plurality of loopers arranged in an array along a curved movement path; and a movement mechanism for moving the plurality of loopers along the curved movement path to selectively position one of the plurality of loopers in a predetermined needle drop position, chain-stitch sewing being performed by cooperation between the one looper selectively positioned in the needle drop position and the hooked needle.

Because the plurality of loopers are arranged along the curved movement path, the looper section can be constructed so that a curved portion is formed at least in the predetermined needle drop position (needle entry position). Thus, the looper section can be formed so that its one end portion including the predetermined needle drop position projects to form the curved portion, and a cylindrical sewing workpiece can be taken to and from the needle drop position via the projecting one end portion. As a consequence, it is possible to provide a looper-selecting structure suited for chain-stitch sewing on the cylindrical sewing workpiece. Further, the novel construction of the present invention, where the plurality of loopers are arranged along the curved movement path, can simplify the looper section located closer to the front surface of the sewing machine and reduce the overall size of the movement mechanism. Thus, the novel construction of the present invention can be advantageously applied to sewing machines that perform chain-stitch sewing on planar sewing workpieces as well as cylindrical sewing workpieces.

As an example, the movement mechanism of the looper section includes: a support member provided, for each of the loopers, for rotatably supporting the looper; a connection section for flexibly interconnecting the support members of individual ones of the loopers; a guide section for guiding the support members, interconnected via the connection section, along the curved movement path; and a drive mechanism for moving the support members, interconnected via the connection section, along the guide section. Such a flexible connecting/moving structure can be advantageously used to position the plurality of loopers along the curved movement path.

BEST MODE FOR CARRYING OUT THE INVENTION

Figure 1:
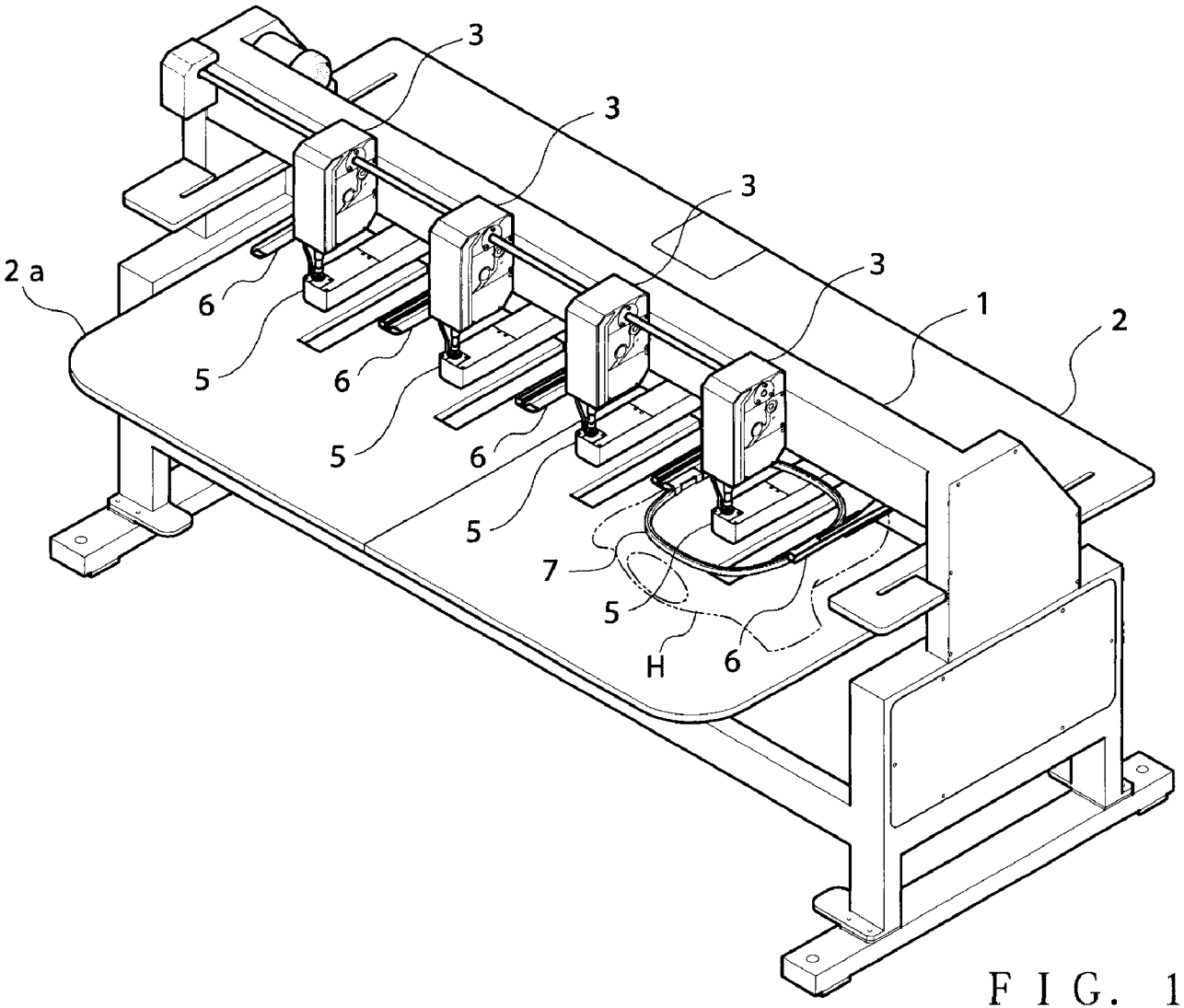
FIG. 1 is a view showing an outer appearance of a multi-head type chain-stitch sewing machine in accordance with an embodiment of the present invention which is equipped with a plurality of chain-stitch sewing machine heads.

FIG. 1 is a view showing an outer appearance of a multi-head type chain-stitch sewing machine in accordance with an embodiment of the present invention, which is equipped with a plurality of chain-stitch sewing machine heads. Reference numeral 1 represents a machine frame, and 2 represents a table that has an ascendable/descendable front table section 2*a*. On the front surface of the machine frame 1, there are provided the plurality of (four in the illustrated example) chain-stitch sewing machine heads 3 whose construction is well known per se. Each of the chain-stitch sewing machine heads 3 has a hooked needle 4 (see FIG. 3 etc.) reciprocatively driven vertically. Cylindrical looper base (looper section) 5 is disposed under each of the machine heads 3. Base frame (not shown) movable in X and Y directions is disposed on the table 2, and a pair of left and right support arms 6 are provided on the base frame per machine head 3. Sewing frame 7 having a cylindrical sewing workpiece H, such as a body part of a T-shirt, is supported by the pair of left and right support arms 6.

Figure 2:
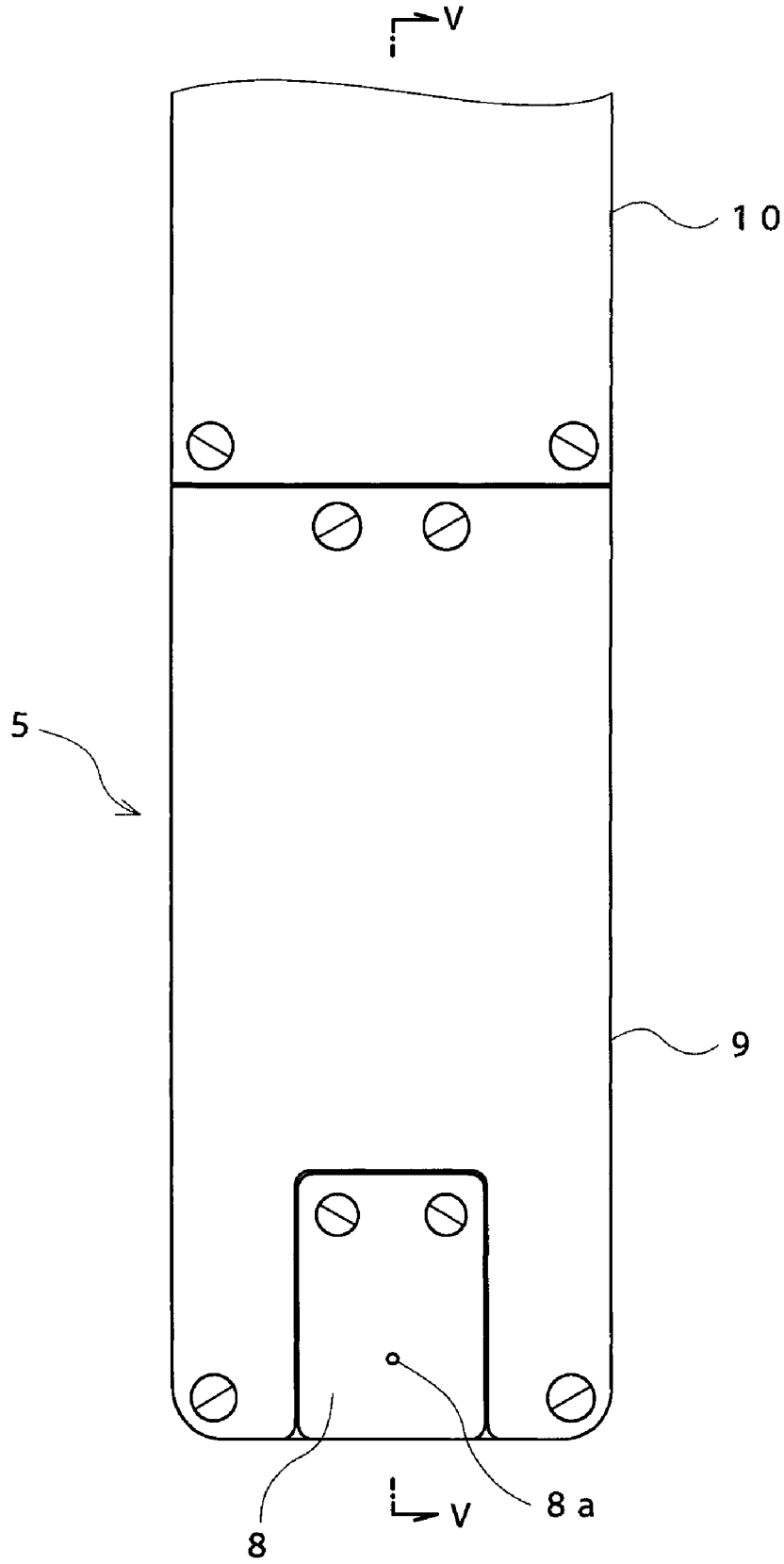
FIG. 2 is a plan view showing a looper base employed in the embodiment.

The looper base 5 has a shape such that its front distal end portion protrudes into a space, e.g. a cylindrical or rod-like shape, so that it can enter inside a sewing workpiece, and it is in the form of a cantilevered support structure having its proximal end portion (rear end portion) fixed to the machine frame 1. FIG. 2 is an enlarged plan view of the looper base 5 in the embodiment. As shown in FIG. 2, a needle plate 8, having a needle hole 8*a* to permit passage therethrough of the hooked needle 4, is fixed to an upper surface portion of the looper base 5 positionally corresponding to a predetermined needle drop position, and the upper surface of the looper base 5 is covered with a looper cover and base cover 10.

Figure 3:
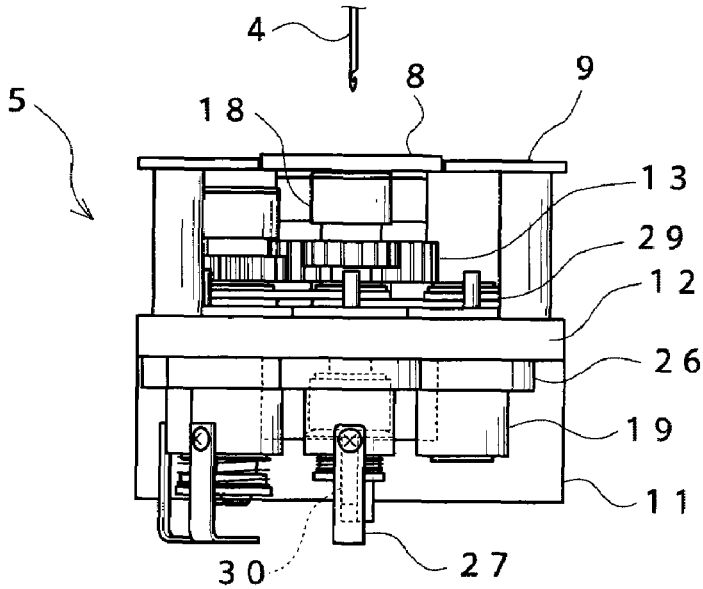
FIG. 3 is a front view of the looper base in the embodiment.
Figure 4:
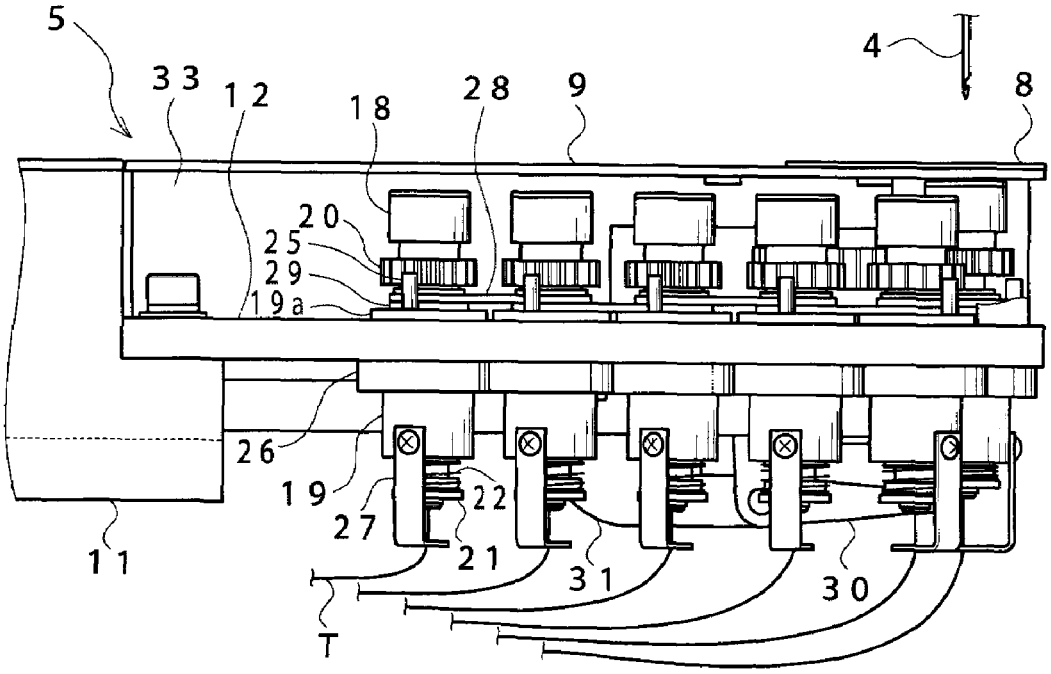
FIG. 4 is a side view showing a front portion of the looper base.
Figure 5:
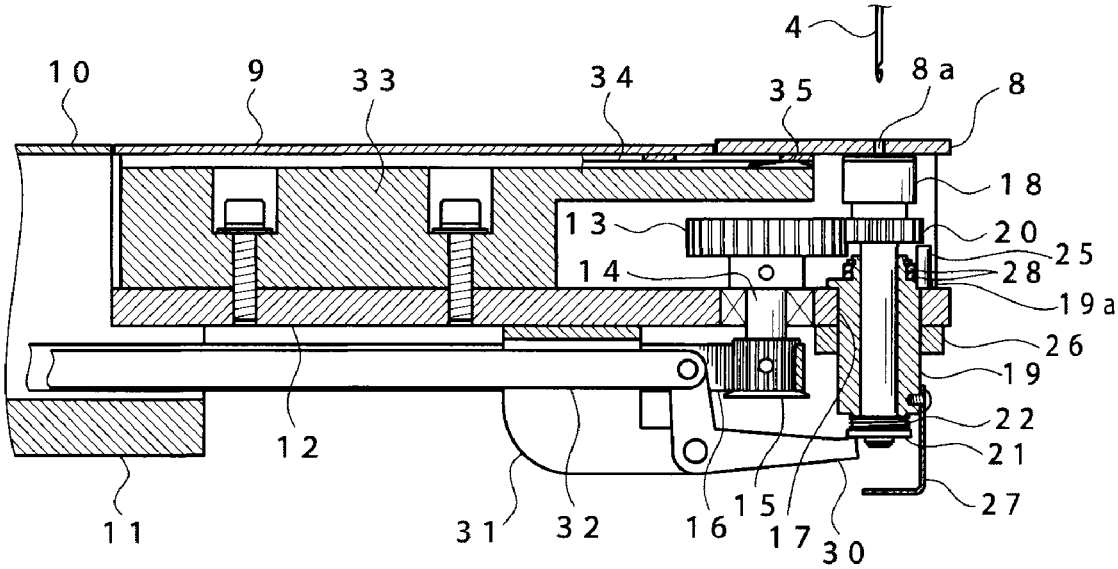
FIG. 5 is a sectional side view taken along the v-v line of FIG. 2.
Figure 6:
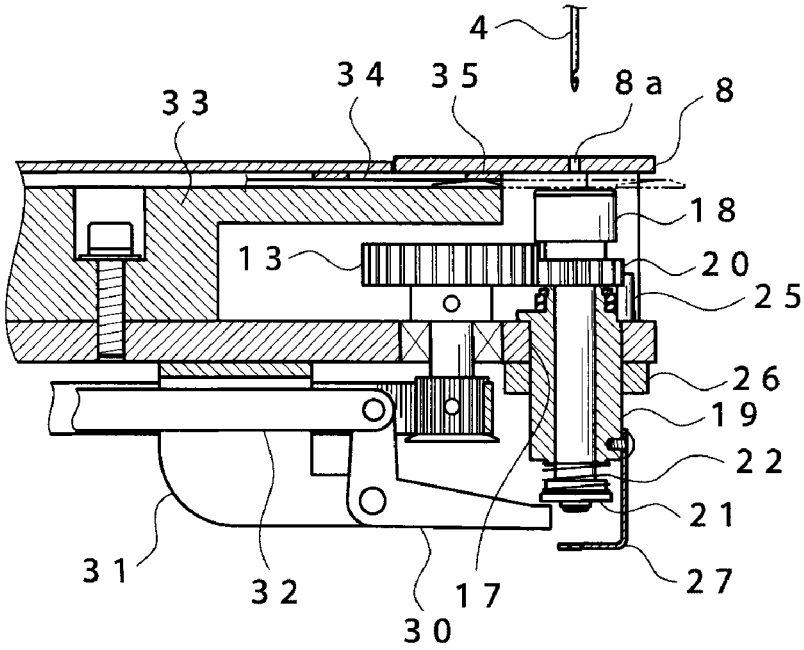
FIG. 6 is sectional side view, similar to FIG. 5, of a distal end portion of the looper base, which is explanatory of behavior of the looper base in an operating state different from that shown in FIG. 5.
Figure 7:
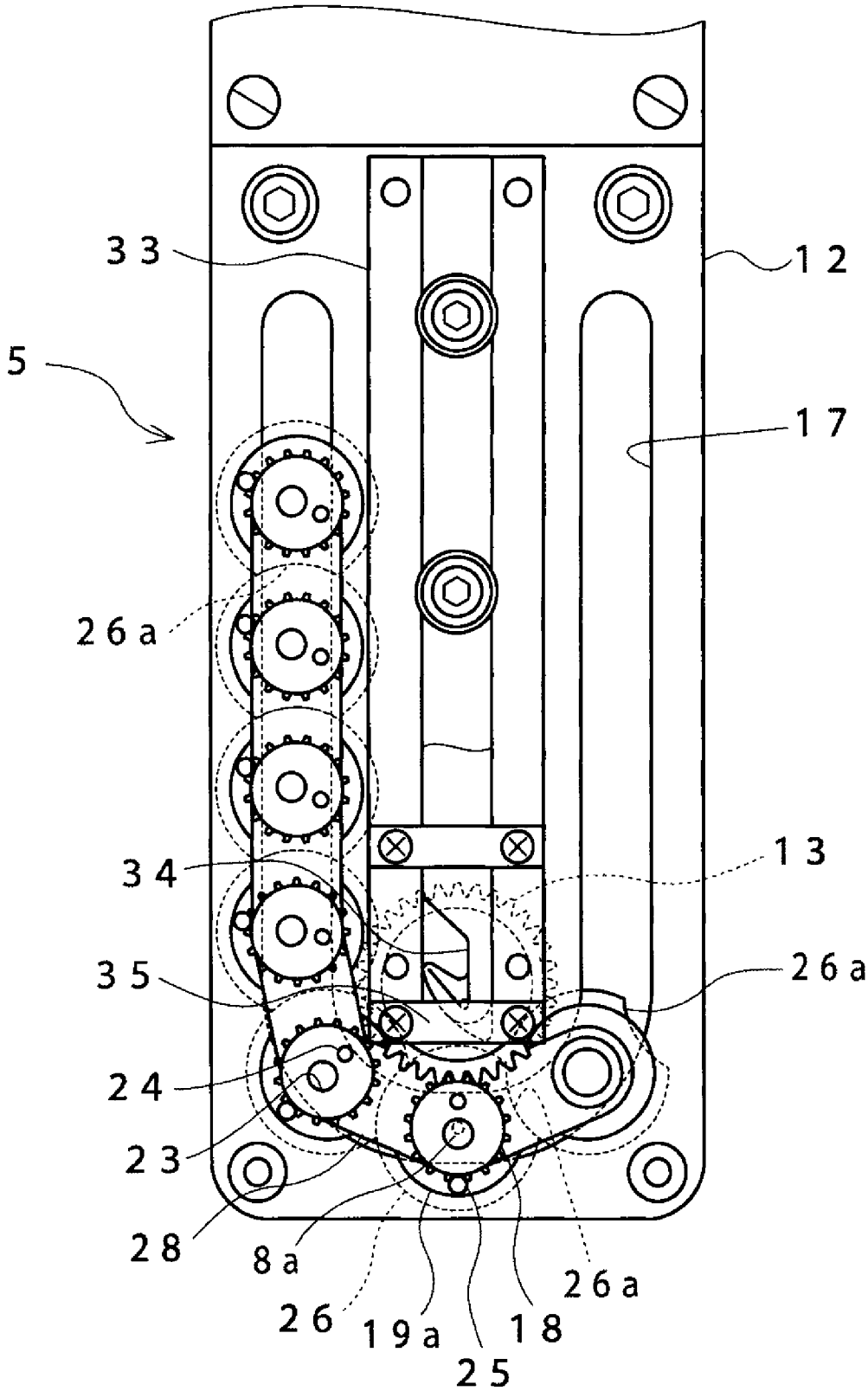
FIG. 7 is a plan view of the looper base with a needle plate and looper cover removed for clarity.
Figure 8:
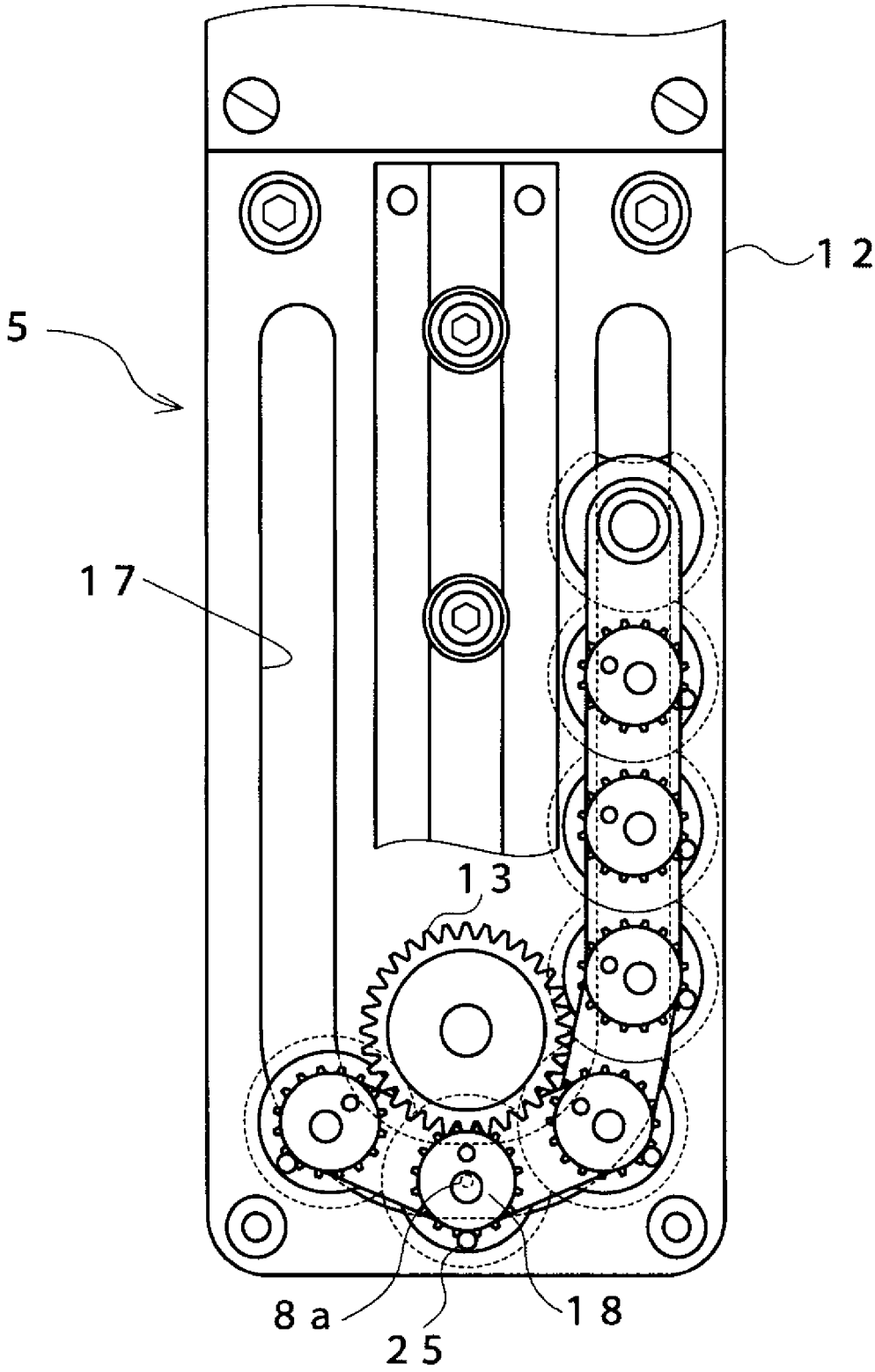
FIG. 8 is a plan view, similar to FIG. 7, which shows a looper selecting state different from that shown in FIG. 7.

Next, a detailed description will be given about a looper-selecting movement mechanism provided on the looper base 5. FIG. 3 is a front view of the looper base 5 employed in the instant embodiment, and FIG. 4 is a side view of a front portion of the looper base 5. FIG. 5 is a sectional side view taken along the v-v line of FIG. 2, and FIG. 6 is sectional side view, similar to FIG. 5, of a distal end portion of the looper base 5, which is explanatory of behavior of the looper base 5. Further, FIG. 7 is a plan view of the looper base 5 with the needle plate 8 and looper cover 9 removed from the upper surface of the looper base 5, and FIG. 8 is a plan view, similar to FIG. 7, which shows a looper selecting state different from that shown in FIG. 7.

As shown in FIG. 4 or 5, a support base 12 is fixed to a front end portion of a base body 11 of the looper base 5. Driving gear 13, rotationally driven via a not-shown drive source, is provided on the support base 12. The driving gear 13 is fixed to an upper end portion of a shaft 14 supported on the support base 12, and a pulley 15 is fixed to a lower end portion of the shaft 14. The pulley 15 is connected to the not-shown drive source via a timing belt 16, and the driving gear 13 is driven to rotate by the drive source. As clearly seen from FIG. 7 or 8, the support base 12 has a U-curved guide groove 17, and a plurality of (e.g., six) loppers 18 are disposed in the guide groove 17. Each of the loopers 18 is rotatably and vertically-movably supported in a support member 19 movably fitted in the guide groove 17, and a driven gear 20 capable of meshing with the driving gear 13 is fixed to the outer periphery of the looper 18. Spring support 21 is mounted on a lower end portion of the looper 18, and a coil spring 22 is fitted between the spring support 21 and the support member 19. By the coil spring 22, the looper 18 is normally urged to a lowered position where the lower surface of the driven pulley 20 abuts against the upper surface of the support member 19.

Figure 9:
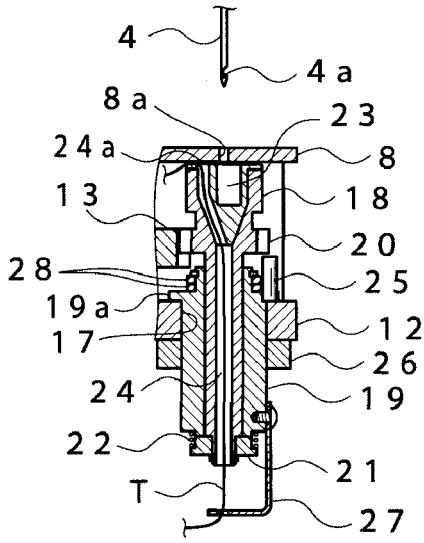
FIG. 9 is a vertical sectional view of one looper located in a predetermined needle drop position.

FIG. 9 is a vertical sectional view of one looper 18 located in a predetermined needle drop position. As clearly seen from the figure, each of the loopers 18 has an upwardly-opening escape hole 23 for insertion therein of the hooked needle 4, and a thread hole 24 formed vertically through the body of the looper 18 to permit passage therethrough a sewing thread T. The thread hole 24 has a bent upper portion, and a thread exit 24*a* at the top of the bent upper portion is offset from the rotation center of the looper 18. As well known, chain-stitch sewing is performed by: rotating the looper 18, with the hooked needle 4 lowered so that a hook portion 4*a* of the needle 4 is located in the escape hole 23, to cause the sewing thread T to be wound around the hooked needle 4; and then raising the hooked needle 4 so that the hook portion 4*a* catches and pulls out the sewing thread T onto the surface of a sewing workpiece. As also known, the sewing thread T is paid out from a thread spool positioned in a not-shown thread stand and supplied from beneath the thread hole 24.

Operation of the looper 18 is controlled via an actuating lever 30 so that it is vertically movable within the support member 19. As shown in FIGS. 5-9, a vertical pin 25 is fixed to a flange portion 19*a* of the support member 19. When the looper 18 is in its lowered position, as shown in FIG. 6, the pin 25 engages with the driven gear 20 to thereby lock the looper 18 against rotation. On the other hand, when the looper 18 is in its uppermost position, as shown in FIG. 5, the pin 25 is held out of the engagement with the driven gear 20 so that the looper 18 can be rotated. Restricting member 26 is fixed to a substantial middle portion of the support member 19, and the support base 12 is sandwiched between the restricting member 26 and the flange portion 19*a* of the support member 19 so that the support member 19 is prevented from moving vertically.

Figure 10:
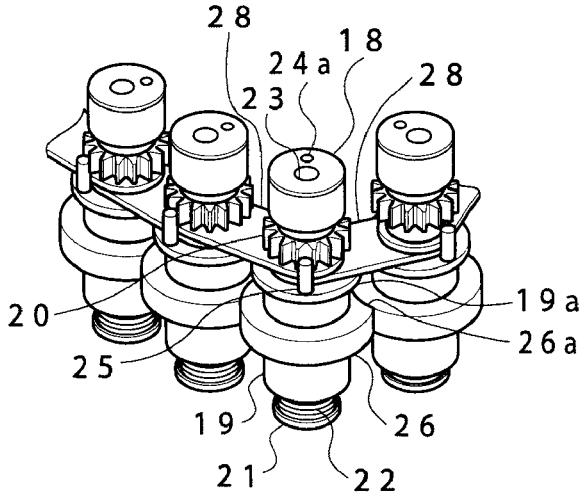
FIG. 10 is a perspective view of a plurality of the loopers arranged in a U-curved array in the looper base, which particularly shows a curved portion of the array.
Figure 11:
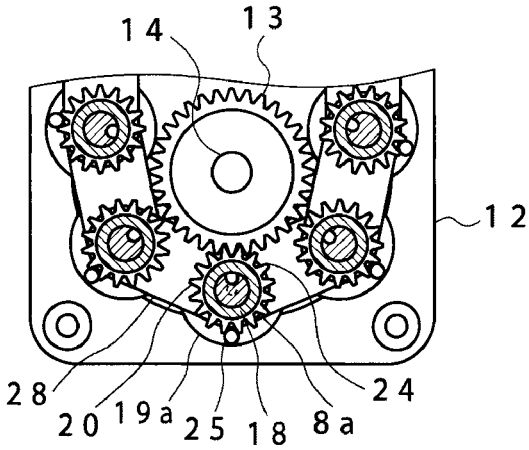
FIG. 11 is a plan view of the curved portion of the looper array shown in FIG. 10.

FIG. 10 is a perspective view of the plurality of the loopers 18 arranged in a U-curved array, which particularly shows a curved portion of the array. FIG. 11 is a plan view of the curved portion of the array. As clear from FIG. 7 or 10, a recessed portion 26*a* is formed in the outer periphery of each of the restricting members 26 provided on the support members 19 in the curved portion, and this recessed portion 26*a* is held in engagement with a projecting portion of the restricting member 26 of the next adjoining support member 19. By the recessed portion 26*a* engaging with the projecting portion of the adjoining restricting member 26, a rotational position of the support member 19 is restricted. Thread guide member 27 for guiding a sewing thread T is fixed to a lower end portion of the support member 19.

In the curved array of the loopers 18, as clearly seen from FIG. 7, one support member 19 is provided per looper 18, but also one dummy support member 19 is provided, as an extra, at an end of the array. Rotational position of each of the restricting members 26 is restricted by the recessed portion 26*a* of the restricting member 26 engaging with the projecting portion of the adjoining restricting member 26, and thus, in order to restrict the rotational position of the restricting member 26 associated with the rightmost looper 18 in FIG. 7, the dummy support member 19, supporting no looper, is provided, along with its restricting member 26, to the right of the rightmost looper 18.

As clear from FIGS. 10, 11, etc., there are provided a plurality of connecting plates 28, each of which is mounted on and interconnecting upper end portions of two adjoining support members 19. With the connecting plates 28 sequentially interconnecting the adjoining support members 19, all of the loopers 18 are connected together flexibly at predetermined intervals so that they can move flexibly along the U-curved guide groove 17. Because only one interconnecting plate 28 is provided for each of the support members 19 located at the opposite ends of the looper array, a spacer 29 (FIG. 4) is provided to allow the one interconnecting plate 28 to have the same height as the other interconnecting plates 28.

In FIG. 7, the needle hole 8*a* of the needle plate 8 is indicated by an imaginary line. Chain-stitch sewing is performed by the hooked needle 4 and one of the loopers 18 which has been selectively positioned immediately below the needle hole 8*a* (namely, in the needle drop position). With the one looper 18 accurately selectively positioned in the predetermined needle drop position, the driving gear 13 engages with only the driven gear 20 of the one looper 18 selectively positioned in the predetermined needle drop position; the driving gear 13 is constantly held in engagement with the driven gear 20 of the selected looper 18 irrespective of whether the selected looper 16 is in the lowered position as shown in FIG. 6 or in the raised position as shown in FIG. 5.

As the driving gear 13 is driven to rotate in a predetermined feeding direction with all of the loopers 18 held in the lowered position and locked against rotation by the pins 25, a rotational driving force would be produced in the driven gear 20 of the looper 18 selectively positioned in the predetermined needle drop position. However, because the driven gear 20 is locked by the support member 19 of the selected looper 18 and rotation of the support member 19 is prevented by the engagement of the support member 19 with the recessed portion 26*a* of the adjoining support member 19, the selected looper 18 moves, together with the associated support member 19, along the guide groove 17 away from the selected position, so that all of the interconnected loopers 18 together move along the guide groove 17. As clear from FIG. 11, in response to the movement of the loopers 18 along the curved movement path, the driven gear 20 of the looper 18 having so far been selected to mesh with the driving gear 13 will be brought out of the meshing engagement with the driving gear 13; however, before the driven gear 20 is brought out of the meshing engagement with the driving gear 13, the driven gear 20 of the adjoining or next looper 18 is brought to meshing engagement with the driving gear 13. In this manner, the driven gears 20 of the mutually-adjoining loopers 18 mesh with the driving gear 13 one after another, so that a driving force to move the array of the loopers 18 can be maintained. FIG. 7 shows a state in which the rightmost looper 18 has been selectively positioned in the predetermined needle drop position (selected position) for use in chain-stitch sewing, and FIG. 8 shows a state in which the second looper 18 from the left end of the looper array has been selectively positioned in the predetermined needle drop position (selected position). At a time point immediately after the looper 18 has been selectively positioned in the predetermined needle drop position (selected position), as seen in these figures, the looper 18 has to be set at an initial position where the thread exit 24*a* of the looper 18 is oriented most rearwardly (i.e., toward the driving gear 13). Therefore, the instant embodiment is arranged to always allow the looper 18, positioned in the selected position, to be first set at the initial position.

As shown in FIG. 5 or 6, the actuating lever 30 is provided beneath the support base 12 for moving the looper 18 having been positioned in the predetermined needle drop position (selected position), i.e. the selected looper 18, to the raised position. The actuating lever 30 has an L shape and is pivotally connected at its bent portion to a bracket 31 fixed to the underside of the support base 12. The actuating lever 30 has a lever section extending forward (rightward in FIG. 5) and abuttable at its distal end against the underside of the spring support 21 of the selected looper 18, and a connecting plate 32 is connected to the distal end of an upward-extending lever section of the actuating lever 30. The connecting plate 32 is connected to a not-shown drive source so that the actuating lever 30 is caused to reciprocatively pivot by the drive source. The actuating lever 30 is normally held in a lowered position as shown in FIG. 6, and the selected looper 18 is normally urged to its lowered position by means of the coil spring 22. During the movement of the looper array as well, the actuating lever 30 is held in the lowered position as shown in FIG. 6 so that the driven gear 20 of the selected looper 18 is locked by the pin 25. When chain-stitch sewing is to be performed, the actuating lever 30 is caused to pivot upward by means of the not-shown drive source, so that the selected looper 18 is moved to the raised position against the biasing force of the coil spring 22. Thus, the engagement between the driven gear 20 of the looper 18 and the pin 25 is canceled, and, as the driving gear 13 is then driven to rotate, the looper 18 is rotated so that chain-stitch sewing is performed by a combination of the rotation of the selected looper 18 and vertical movement of the hooked needle 4.

As clear from FIGS. 5, 6, 7 etc., a knife base 33 is fixed to the upper surface of the support base 12. Movable knife 34 is provided on the knife base 33, and when the selected looper 18 is in the lowered position, the knife 34 is movable into and away from between the upper surface of the selected looper 18 and the lower surface of the needle plate 8. Fixed knife 35 is fixed to the knife base 33, which cuts a sewing thread T in conjunction with the movable knife 34 as the latter moves away from between the upper surface of the selected looper 18 and the lower surface of the needle plate 8. The sewing thread T stretched between the needle hole 8*a* of the needle plate 8 and the thread exit 24*a* of the looper 18 is captured and cut by the reciprocative movement of the movable knife 34 and operation of the fixed knife 35. Further, a thread retaining device (not shown) is provided on the knife base 33, which retains a looper-side end of the sewing thread T having been cut by the movable knife 34 and fixed knife 34.

Next, a description will be given about operation of the sewing machine when chain-stitch sewing is to be performed. Threads T of different colors and characteristics, paid out from a plurality of spools set on the thread stand (not shown), are set in advance on the individual loopers 18. Each of the sewing threads T is passed through a thread hole of the thread guide member 27 and thread hole 24 of the looper 18 and then led out of the looper 18 via the thread exit 24*a*, and the distal end of each of the sewing threads T led out of the looper 18 is retained by the thread retaining device. When chain-stitch sewing is to be started, first, the looper 18 having a desired thread T set thereon is positioned in the predetermined needle drop position (selected position). For selection of such a desired looper 18, the driving gear 13 is driven to rotate while all of the loopers 18 are in the lowered position, to thereby move the looper array along the guide groove 17 until the desired looper 18 is positioned in the predetermined needle drop position (selected position). The sewing threads T passed through the loopers 18 would tighten and slacken in response to the movement of the loopers 18. Therefore, a thread slackening/tightening device (not shown) is provided, under the base body 11 of the looper base 5, for slackening or tightening the threads T in response to the movement of the loopers 18.

Once the desired looper 18 is positioned in the predetermined needle drop position (selected position), the actuating lever 30 is caused to pivot upward to move the selected looper 18 to the raised position (FIG. 5). In this situation, the driving gear 13 is driven to rotate the looper 18 and the hooked needle 4 is moved vertically, in synchronism with which the sewing frame 7, having a cylindrical sewing workpiece H set thereon, is driven in the X and Y directions in accordance with desired sewing pattern data. In this manner, chain-stitch sewing of a desired pattern is performed on the sewing workpiece H.

When the sewing thread T used for the chain-stitch sewing is to be changed to another one, the rotation of the looper 18 and vertical movement of the hooked needle 4 is stopped, and then the actuating lever 30 is caused to pivot downward so that the currently-selected looper 18 is moved to the lowered position (see FIG. 6). Then, the movable knife 34 is moved forward and backward to cut the sewing thread T. After that, the driving gear 13 is driven so that the looper 18, having set thereon the sewing thread T to be next used, is positioned in the needle drop position (selected position), and then, the actuating lever 30 is caused to pivot upward to move the looper 18 to the raised position (FIG. 5). After that, the looper 18 is rotated and the hooked needle 4 is vertically moved to perform chain-stitch sewing, in a similar manner to the above-described. As known in the art, examples of chain-stitch sewing include chain sewing, loop sewing, etc., and switching can be made among these chain sewing, loop sewing, etc. in response to setting of a desired sewing operation.

According to the instant embodiment, as described above, the support members 19 supporting the loopers 18 are interconnected via the connecting plates 28, so that the plurality of loopers 18 can be moved flexibly along the U-shaped guide groove 17. The movement path of the loopers 18 is not limited to the U-shaped movement path, and any other suitable movement path may be set freely. Thus, the plurality of loopers 18 may be arranged in a space of a reduced width so that the looper base 5 can be constructed as a structure of a reduced width, such as a cylindrical structure; in this way, the looper base 5 can be constructed in such a manner that a desired looper can be positioned inside various types of sewing workpieces H of cylindrical shapes. Further, the rotational position of the support member 19 is restricted by the restricting member 26, and the looper 18 is locked, by the pin 25, to the support member 10 against rotation. Thus, each looper 18, having been positioned in the needle drop position (selected position), can be set in the same initial rotational position, so that the initial rotational position of each looper 18 to be used for chain-stitch sewing can also be reliably associated with the predetermined original position.

Whereas, in the above-described embodiment, the connecting plates 28, each interconnecting two adjoining support members 19, are provided only on upper end portions of the support members 19, such connecting plates 28 may also be provided beneath the support base 12 to interconnect the adjoining support members 19 at their lower end portions. If the support members 19 are interconnected via the connecting plates 28 at two positions over and under the support base 12, the support members 19 can be moved with increased smoothness because no inclining force is applied to the support members 19 during the movement. Further, whereas, in the above-described embodiment, both the looper-moving driving for selectively positioning a desired one of the plurality of loopers 18 in the needle drop position and the rotational driving for rotating the selected looper 18 at the time of sewing operation are effected by the common drive source via the driving gear 13, the looper-moving driving and the rotational driving may be effected by separate drive sources. For example, in a case where the driving gear 13 is driven by a pulse motor, there arises a need to perform control for switching between loop gains (load following capabilities) corresponding to the looper-moving driving and rotational driving. However, if the looper-moving driving and the rotational driving are effected by separate drive sources, such switching control can be dispensed with.

Further, the movement path of the plurality of loopers 18 may be of any suitable curved shape without being limited to the aforementioned U shape. For example, the movement path of the plurality of loopers 18 may be of a circular shape, in which case too the looper section can be positioned inside a cylindrical sewing workpiece H. Furthermore, the present invention is not limited to the aforementioned construction where the adjoining loopers 18 are interconnected via the connecting plates 28 so as to move flexibly along the path, and may employ an inflexible looper moving construction. In the case where the looper movement path is of a circular shape, an inflexible looper moving construction may be made rotatable like a turntable.

Further, the moving mechanism for moving the plurality of loopers 18 is not limited to the construction comprising the combination of the driving gear 13 and guide groove 17 and may be constructed in any other suitable manner. For example, a desired curved movement path of the loopers 18 may be formed by a timing belt wound on and extended between driving and driven pulleys, and the support members 10 carrying the respective loopers 18 may be connected to the timing belt with the recessed portion 26*a* of the restricting member 26 of each of the support members 19 held in engagement with the projecting portion of the restricting member 26 of the next adjoining support member 19. In this case, a chain may be used, as a driving force transmission means, in place of the timing belt. In the case where the support members 10 carrying the respective loopers 18 are connected to a flexible driving force transmission means, such as a timing belt or chain, as noted above, the connecting plates 28 for interconnecting the adjoining loopers 18 as in the above-described embodiment can be dispensed with because the flexible driving force transmission means itself functions as connecting members or connection means for flexibly interconnecting the loopers 18.

Further, the curved movement path along which the adjoining loopers 18, interconnected by the connection means (28), are flexibly moved, need not necessarily be constructed to be positioned inside a cylindrical sewing workpiece H. Namely, the present invention may be applied to sewing machines for performing chain-stitch sewing on planar sewing workpieces.

The sewing frame 7, which is driven in the X and Y directions in accordance with sewing pattern data, may also be subjected to rotational driving as conventionally known in embroidery sewing of hats etc. without being limited to planar X/Y driving. Further, the present invention may be constructed so that the machine heads 3 and looper bases 5 are moved in accordance with sewing pattern data.

The invention claimed is:

1. A sewing machine including a reciprocatively-driven hooked needle and a looper section disposed under a needle plate, said looper section including:

a plurality of loopers arranged in an array along a curved movement path; and a movement mechanism for moving the plurality of loopers along the curved movement path to selectively position one of the plurality of loopers in a predetermined needle drop position, chain-stitch sewing being performed by cooperation between the one looper selectively positioned in the needle drop position and said hooked needle;

wherein the curved movement path of the plurality of loopers in said looper section has a U shape.

2. A sewing machine as claimed in claim 1 wherein said looper section projects at one end portion thereof including the predetermined needle drop position, and a cylindrical sewing workpiece can be taken to and from the needle drop position, and wherein the array of the plurality of loopers is curved in the one end portion.

3. A sewing machine including a reciprocatively-driven hooked needle and a looper section disposed under a needle plate, said looper section including:

a plurality of loopers arranged in an array along a curved movement path; and a movement mechanism for moving the plurality of loopers along the curved movement path to selectively position one of the plurality of loopers in a predetermined needle drop position, and wherein chain-stitch sewing is performed by cooperation between the one looper selectively positioned in the needle drop position and said hooked needle, and wherein said movement mechanism of said looper section includes: a support member provided, for each of the loopers, for rotatably supporting the looper; connection means for flexibly interconnecting the support members of individual ones of the loopers; a guide section for guiding said support members, interconnected via said connection means, along the curved movement path; and a drive mechanism for moving said support members, interconnected via said connection means, along said guide section.

4. A sewing machine as claimed in claim 1 wherein the loopers in said looper section are rotatably supported by respective ones of support members, and each of said support members is provided with a member for restricting rotation of the looper.

5. A sewing machine as claimed in claim 3 wherein said looper section projects at one end portion thereof including the predetermined needle drop position, and a cylindrical sewing workpiece can be taken to and from the needle drop position, and wherein the array of the plurality of loopers is curved in the one end portion.

6. A sewing machine as claimed in claim 3 wherein each of said support members is provided with a member for restricting rotation of the looper.

7. A sewing machine including a reciprocatively-driven hooked needle and a looper section disposed under a needle plate, said looper section including:

a plurality of loopers arranged in an array along a curved movement path; and a movement mechanism for moving the plurality of loopers along the curved movement path to selectively position one of the plurality of loopers in a predetermined needle drop position, chain-stitch sewing being performed by cooperation between the one looper selectively positioned in the needle drop position and said hooked needle, wherein the loopers in said looper section are rotatably supported by respective ones of support members, and each of said support members is provided with a member for restricting rotation of the looper, and wherein said member for restricting rotation of the looper has a recessed portion engaging with a next adjoining one of the support members, and the rotation of the looper is restricted by said member for restricting rotation engaging with the next adjoining support member via the recessed portion.

8. A sewing machine as claimed in claim 7 wherein a member for restricting rotation of the looper relative to the support member is provided on said support member.

9. A sewing machine as claimed in claim 7 wherein said looper section projects at one end portion thereof including the predetermined needle drop position, and a cylindrical sewing workpiece can be taken to and from the needle drop position, and wherein the array of the plurality of loopers is curved in the one end portion.

* * * * *